United States Patent [19]

Scheurecker

[11] 4,197,903

[45] Apr. 15, 1980

[54] ARCUATE SUPPORTING AND GUIDING CONSTRUCTION FOR CONTINUOUSLY CAST STRANDS

[75] Inventor: Werner Scheurecker, Linz, Austria

[73] Assignee: Voest-Alpine Aktiengesellschaft, Linz, Austria

[21] Appl. No.: 916,926

[22] Filed: Jun. 19, 1978

[30] Foreign Application Priority Data

Jun. 28, 1977 [AT] Austria ..... 4558/77

[51] Int. Cl.[2] ..... B22D 11/12

[52] U.S. Cl. ..... 164/448

[58] Field of Search ..... 164/448, 447, 442, 441, 164/82

[56] References Cited

U.S. PATENT DOCUMENTS

| | | | |
|---|---|---|---|
| 4,007,822 | 2/1977 | Scheurecker | 164/448 |
| 4,034,796 | 7/1977 | Loibl et al. | 164/448 |
| 4,046,188 | 9/1977 | Kagerhuber et al. | 164/448 |
| 4,074,746 | 2/1978 | Scheurecker et al. | 164/442 |
| 4,079,775 | 3/1978 | Scheinecker et al. | 164/82 |
| 4,116,262 | 9/1978 | Kagerhuber et al. | 164/448 |
| 4,146,083 | 3/1979 | Scheurecker et al. | 164/448 |

FOREIGN PATENT DOCUMENTS

| | | | |
|---|---|---|---|
| 407422 | 8/1966 | Switzerland | 164/442 |

*Primary Examiner*—Robert D. Baldwin
*Assistant Examiner*—J. Reed Batten, Jr.
*Attorney, Agent, or Firm*—Brumbaugh, Graves, Donohue & Raymond

[57] ABSTRACT

A supporting and guiding arc for continuously cast strands has roller paths, whose rollers are mounted in arcuate longitudinal carriers arranged in a supporting framework, to support the strands at opposing sides. The arc has two parts detachably connected and carrying the roller paths, i.e. an arc outer framework part carrying the outer roller path and an arc inner part carrying the inner roller path. The two parts are connected by a number of drawing anchors arranged at a distance from each other and at right angles to the roller paths. These anchors are detachable from one of the parts and are removable out of the connecting position with that part. The arc inner part carrying the arc inner roller path is pivotable, in the arc plane on the framework carrying the outer roller path, about a pivot axle arranged on the lower, run-out end of the framework.

8 Claims, 5 Drawing Figures

ARCUATE SUPPORTING AND GUIDING CONSTRUCTION FOR CONTINUOUSLY CAST STRANDS

BACKGROUND OF THE INVENTION

The invention relates to a supporting and guiding arc for cast strands, in particular for cast slabs, having roller paths supporting the strand on opposing sides. The rollers of the roller paths are mounted in arcuate longitudinal carriers arranged in a supporting framework. Suitably the arcuate longitudinal carriers of one roller path or of both roller paths are adjustable or braceable, under elastic deformation, relative to the supporting framework for adjustment to various strand thicknesses. The arc includes two parts, each carrying a roller path, and detachably connected with each other, i.e. an outer framework part carrying the roller path of the arc outer side and an arc inner part carrying the arc inner roller path. These parts are connected by a number of drawing anchors arranged at a distance from each other and at right angles to the roller paths, which drawing anchors are detachable from one of the parts and removable from the connecting position with that part.

Such a supporting and guiding arc, capable of being disassembled within a short period of time into parts carrying one roller path each, has been disclosed in U.S. Pat. No. 4,146,083 issued Mar. 27, 1979.

The arc outer roller path in this supporting and guiding arc is easily accessible from above after lifting of the arc inner part. In order to also make it possible to have access to the rollers of the arc inner roller path from above, the arc inner part had to be deposited beside the framework and then turned, which procedure was complicated because of the bulkiness and weight of the arc inner part.

SUMMARY OF THE INVENTION

The invention has as its object to provide a supporting and guiding arc of the initially-described kind in an advantageous manner, so that the arc inner part can be brought into a position in which its rollers are easily accessible from above, in a simple way, requiring little space, and no expensive and complex machinery. In particular, part of the weight of the arc inner part is supported against the base, so that the manipulations during turning of the arc inner part can be carried out more easily.

These objects are achieved according to the invention in that the arc inner part carrying the arc inner roller path can be pivoted, in the arc plane on the framework carrying the arc outer roller path, about a pivot axle arranged on the lower end of the framework at the run-out side.

According to a preferred embodiment a pair of carrying lugs is each arranged on both sides of the roller paths on the lower end of the supporting framework, one carrying lug being connected with the arc inner part and the other carrying lug being connected with the framework part. Each pair of carrying lugs is connectable by means of a pin forming the pivot axle, which pin is displaceable out of the connecting position into a releasing position and vice versa.

The pin is suitably hollow and is capable of having one end slipped over a pin-like projection fastened to one lug.

In order to be able to completely detach the arc inner part from the outer framework part, the end of the pin allocated to the projection is advantageously provided with an upwardly directed opening, having guide runners on each side for allowing the projection to pass therethrough.

A simple method of construction is brought about when the carrying lugs arranged on the arc inner part are formed by arcuate longitudinal carriers and the pin-like projection is fastened to them. The lifting lugs are advantageously arranged at the upper end of the arc inner part on the arcuate longitudinal carriers.

For safely supporting the pivoted arc inner part, suitably a support is provided for accommodating the pivoted arc inner part has support faces for engaging the arcuate longitudinal carriers.

BRIEF DESCRIPTION OF THE DRAWINGS

The invention will be explained in more detail by way of one embodiment and with reference to the accompanying drawings, wherein.

DESCRIPTION OF AN ILLUSTRATIVE EMBODIMENT

Figure 1:
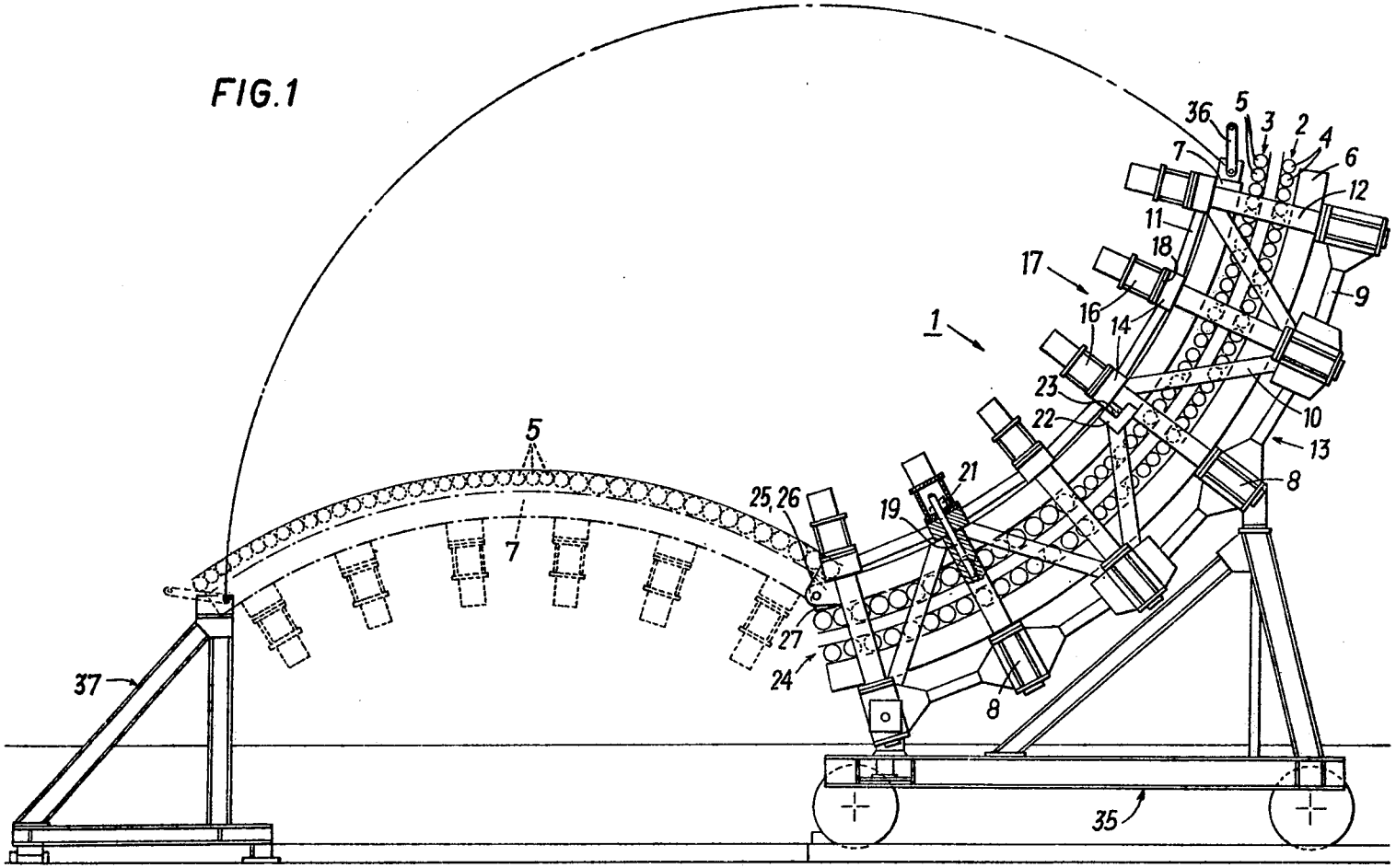
FIG. 1 illustrates a partially-sectioned side view of a schematic representation of a supporting and guiding arc according to the invention.
Figure 5:
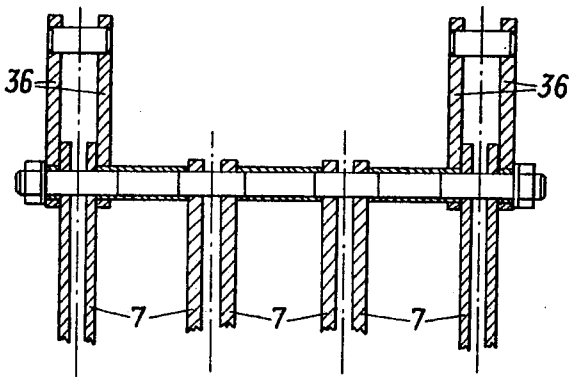
FIGS. 4 and 5 illustrate sections along lines IV—IV of FIG. 2 and V—V of FIG. 3, respectively.

A supporting and guiding arc denoted by 1 comprises two opposing roller paths 2 and 3, which extend approximately from the vertical into the horizontal. Rollers 4, 5 of both roller paths 2, 3 are fastened to longitudinal carriers 6, 7 extending over the total length of the guiding arc, by means of pedestals not illustrated. The arcuate longitudinal carriers 6 carrying the arc outer roller path 2 are fastened to transverse carriers 8 by screws not illustrated in detail. By means of props 9, 10, 11 and 12 arranged on both sides of the roller path, the transverse carriers 8 are connected into an arcuate arc outer framework part 13.

Figure 3:
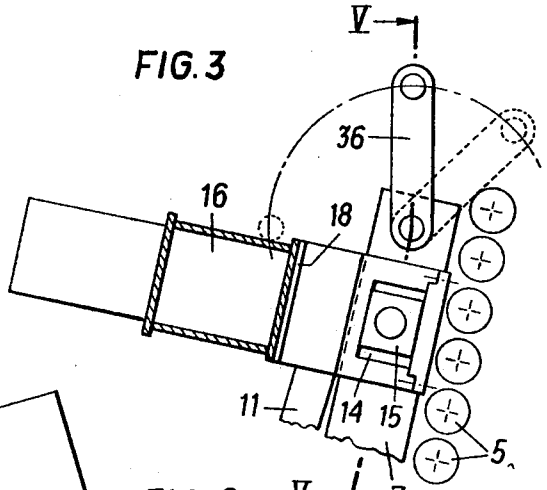
FIGS. 2 and 3 show the details of the drawing anchors at the lower run-out end and the sliding blocks at the run-in end of FIG. 1, respectively, on a larger scale.
Figure 2:
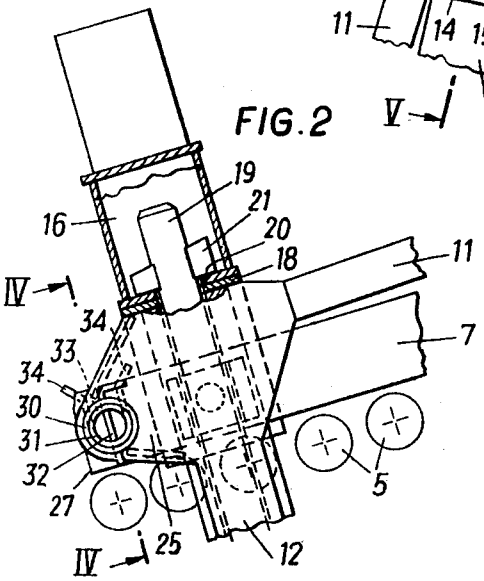

The arcuate longitudinal carriers 7, which have the rollers of the arc inner roller path 3 distributed over their lengths, comprise several rings 14 having slots. Within the slots are sliding blocks 15 displaceably arranged for the purpose of adjusting the opposing roller paths 2 and 3 to different strand thicknesses FIG. 3. The sliding blocks 15 are each detachably connected with transverse carriers 16. The arcuate longitudinal carriers 7 with the transverse carriers 16 thus form a construction unit, which is referred to as the arc inner part 17 (FIG. 1). This arc inner part 17, in the operating position, rests with its transverse carriers 16 on the flange-like ends 18 of the props 12 of the outer framework part 13, which is arranged at a right angle to the roller paths (FIG. 2). Within the props 12 drawing anchors 19 extending in the longitudinal direction of the props are provided, which anchors can be totally retracted by means of pressure medium cylinders not illustrated into the props 12 from a position in which they project beyond the ends 18 of the props 12.

The transverse carriers 16 of the arc inner part 17 comprise bores 20, which are penetrated by the drawing anchors 19 when the framework part 13 is assembled with the arc inner part 17. Fastening of parts 13 and 17 to each other is effected by wedges 21, which can be inserted in transverse recesses of the drawing anchors 19 and are operable by pressure medium cylinders (not illustrated) for quick and simultaneous actuation. For an easier alignment of the two parts 13 and 17 when they are assembled, consoles 22 are provided on one of the prop pairs 12, with which consoles the arc inner part 17 via its counter faces 23 that correspond to these consoles, is brought to a stop.

Figure 4:
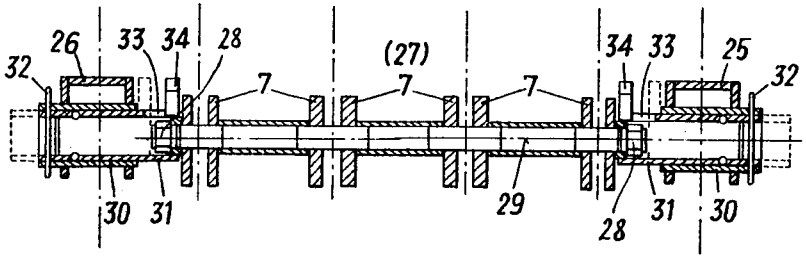

According to the invention carrying lugs 25, 26 are arranged on the lower, run-out end 24 of the framework part 13 on both sides of the roller paths 2, 3, which carrying lugs each lie opposite the lower end 27 of the outer arcuate longitudinal carriers 7 of the arc inner part 17. These outer arcuate longitudinal carriers 7 are each provided with a pin-like projection 28 (FIG. 4), whose axis 29 is directed parallel to the rollers 4, 5. In each of the carrying lugs 25, 26, as can be seen from FIGS. 2 and 4, a pipe section 30 aligned with the projection 28 is welded in place, which pipe serves as a sliding guide for a hollow pin 31. The pin 31 is displaceable from the engagement position, in which it partly encompasses the projection 28 (illustrated in FIG. 4 in full lines) into a releasing position shown in dotted line, in which the pin 31 totally releases the projection 28. A cotter pin 32 penetrating both the pin 31 and the guide pipe 30 serves for securing the pin 31 in its two positions. The hollow pin 31, on its end facing the projection 28, comprises an opening 33 directed upwardly and having laterally arranged guiding runners 34, so that the projection 28 can be upwardly removed from the pin, when the pin 31 is in the engagement position.

For separating the arc inner part 17 from the framework part 13, after the guiding arc 1 has been moved out of the continuous casting plant to a repair stand, for instance by means of a car 35, the pins 31, which are in the release position during operation, are displaced into the engagement position and secured in this position by the cotter pins 32. Suitably, the sliding blocks 15 are then fastened to the arcuate longitudinal carriers, for instance by an insert piece, so that the transverse carriers 16 are rigidly fixed to the longitudinal carriers 7. Then, after separation from the transverse carriers 16 of the arc inner part 17, the drawing anchors 19 are retracted into the props 12. The arc inner part 17 is then pivoted into the position shown in FIG. 1 by the dash-line about the axis 29 of the projections 28, for instance by means of a crane suspension engaged in lugs 36 that are hinged to the longitudinal carriers 7 on the upper end of the arc inner part 17. The weight of the arc inner part 17 in this case is accommodated by the framework part 13 via the pins 31 in which the projections 28 are mounted during pivoting. The upper end of the arc inner part is laid with the arcuate longitudinal carriers 7 on a support 37 after pivoting.

Both roller paths in this position are easily accessible for checking and repair work. If the arc inner part 17 is to be totally separated from the arc outer framework part 13, the arc inner part need to be lifted only slightly, so that the projections 28 will slide through the openings 33 out of the pins 31. The runners 34 make the assembly of the guiding arc easier, when the projections 28 are reinserted into the pins 31.

What I claim is:

1. In an arcuate supporting and guiding construction for continuously cast strands of the type including a supporting framework having an upper end and a lower, run-out end, a set of inner arcuate longitudinal carriers and a set of outer longitudinal carriers positioned within the supporting framework, a plurality of rollers mounted in each of the sets of longitudinal carriers to form an arc inner roller path and an arc outer roller path for supporting said continuously cast strands on opposing sides thereof, said supporting framework being comprised of two parts, one of said two parts being an arc outer framework part carrying said arc outer roller path, and the other one of said two framework parts being an arc inner part carrying said arc inner roller path, and a plurality of drawing anchors arranged at a distance from one another and at right angles to the arcuate roller paths for detachably connecting said two parts of said supporting framework, the improvement comprising pivot axle means arranged on said arc outer framework part at the lower, run-out end thereof, said arc inner part being pivotable about said pivot axle means in the arc plane of the outer framework part.

2. An arcuate supporting and guiding construction as set forth in claim 1, wherein at least one of said sets of arcuate longitudinal carriers is adjustable and braceable to said supporting framework under elastic deformation for adjustment to various strand thicknesses.

3. An arcuate supporting and guiding construction as set forth in claim 1, further comprising lifting lugs provided on said inner arcuate longitudinal carriers on the upper end of said arc inner part.

4. An arcuate supporting and guiding construction as set forth in claim 1, further comprising a support for accommodating said arc inner part when pivoted, said support having support faces provided for accommodating said inner arcuate longitudinal carriers of said arc inner part.

5. In an arcuate supporting and guiding construction for continuously cast strands of the type including a supporting framework having an upper end and a lower, run-out end, a set of inner arcuate longitudinal carriers and a set of outer longitudinal carriers positioned within the supporting framework, a plurality of rollers mounted in each of the sets of longitudinal carriers to form an arc inner roller path and an arc outer roller path for supporting said continuously cast strands on opposing sides thereof, said supporting framework being comprised of two parts, one of said two parts being an arc outer framework part carrying said arc outer roller path, and the other one of said two framework parts being an arc inner part carrying said arc inner roller path, and a plurality of drawing anchors arranged at a distance from one another and at right angles to the arcuate roller paths for detachably connecting said two parts of said supporting framework, the improvement comprising:

first carrying lugs connected to said arc inner part and second carrying lugs connected to said arc outer framework, said first carrying lugs and said second carrying lugs forming a pair of carrying lugs on each side of said roller paths at the lower, run-out end of said supporting framework; and pivot axle means arranged on said arc outer framework part at the lower, run-out end thereof, said arc inner part being pivotable about said pivot axle means in the arc plane of the outer framework part, said pivot axle means being formed by a pin by which the lugs of each pair of carrying lugs are interconnectable, said pin being displaceable from a connecting position into a releasing position and vice versa.

6. An arcuate supporting and guiding construction as set forth in claim 5, further comprising a pin-like projection fastened to one carrying lug of each pair of carrying lugs, and wherein said pin is hollow-shaped and has two ends, one end of said pin being capable of being slipped over said pin-like projection.

7. An arcuate supporting and guiding construction as set forth in claim 6, wherein said one end of said pin allocated to said pin-like projection is provided with an opening, said opening being upwardly directed and having guiding runners on either side, said opening being such that said pin-like projection may pass there through and be guided by said runners.

8. An arcuate supporting and guiding construction as set forth in claim 6, wherein said first carrying lugs are formed by said inner arcuate longitudinal carriers, said pin-like projection being fastened to each of said first carrying lugs.

* * * * *